United States Patent [19]

Birt

[11] Patent Number: 4,575,787

[45] Date of Patent: Mar. 11, 1986

[54] ROAD VEHICLE HEADLAMP

[75] Inventor: David A. Birt, Cannock, United Kingdom

[73] Assignee: Lucas Industries, England

[21] Appl. No.: 538,819

[22] Filed: Oct. 5, 1983

[30] Foreign Application Priority Data

Oct. 15, 1982 [GB] United Kingdom ..... 8229538

[51] Int. Cl.[4] ..... F21V 7/09

[52] U.S. Cl. ..... 362/297; 362/61; 362/346

[58] Field of Search ..... 362/61, 297, 296, 346, 362/347, 309, 339

[56] References Cited

U.S. PATENT DOCUMENTS

| | | | |
|---|---|---|---|
| 4,208,704 | 6/1980 | Draper | 362/297 |
| 4,238,817 | 12/1980 | Fratty | 362/309 |
| 4,271,459 | 6/1981 | James | 362/297 |
| 4,276,583 | 6/1981 | Fratty | 362/346 |
| 4,276,584 | 6/1981 | Ichikawa | 362/339 |
| 4,351,018 | 9/1982 | Fratty | 362/297 |
| 4,481,563 | 11/1984 | Snyder et al. | 362/346 |

FOREIGN PATENT DOCUMENTS

| | | | |
|---|---|---|---|
| 31211 | 7/1981 | European Pat. Off. | 362/61 |
| 1001210 | 1/1956 | Fed. Rep. of Germany . | |
| 2856448 | 7/1980 | Fed. Rep. of Germany | 362/309 |
| 2143143 | 6/1972 | France . | |
| 1604465 | 5/1977 | United Kingdom . | |
| 2000266 | 6/1978 | United Kingdom . | |
| 2069121 | 8/1981 | United Kingdom | 362/309 |
| 2102934 | 2/1983 | United Kingdom | 362/61 |

*Primary Examiner*—Ira S. Lazarus

*Attorney, Agent, or Firm*—Andrus, Sceales, Starke & Sawall

[57] ABSTRACT

A high aspect ratio passing beam headlamp has a body provided with front opening and a rear opening which is displaced below the horizontal median line of the headlamp. Within the body is a pair of lateral curved reflective portions and separated by an upper curved reflective portion. The foci of the reflective portions are coincident. A bulb is mounted in the rear opening. A U-shaped bulb filament shield rests against a lower planar portion of the body and has arms which provide a horizontal cut-off on both sides of the bulb. The lateral curved reflective portions and have their optical axes mutually inclined in both the horizontal and vertical directions such that the beam pattern projected by the reflector from the shielded filament has, at 25 meters from the headlamp, a lower beam portion having a horizontal upper cut-off, an intermediate beam portion having an upwardly inclined cut-off extending from one side of the upper off the lower beam portion, and an upper beam portion having a horizontal upper cut-off extending from the inclined cut-off on the opposite side thereof to the lower beam portion, the lower beam portion being provided by one of the curved reflective portions and the intermediate and upper beam portions being provided by the other of the curved reflective portions.

9 Claims, 12 Drawing Figures

ROAD VEHICLE HEADLAMP

This invention relates to a road vehicle headlamp for use under passing beam conditions. Such a headlamp will be referred to hereinafter as a "passing beam headlamp". The invention is also applicable to combined passing beam and driving beam headlamps.

Figure 1:
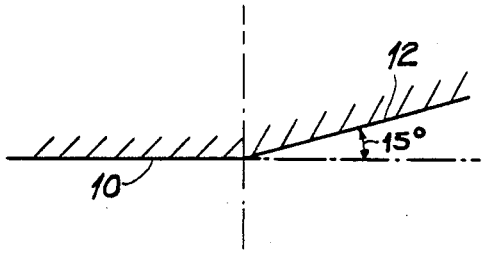

Passing beam headlamps are used when a driver requires the road to be illuminated without dazzling other drivers. Regulations lay down strict specifications for the light beam pattern produced by the passing beam headlamp. In particular, there is a strict control on the light intensity at the top of the beam. For instance, the E C E Regulations require a sharp cut-off to the top of the beam to avoid glare and permit basically two shapes of cut-off. One of these is much used cut-off consisting of a horizontal section and a 15° slope section (see FIG. 1). In the most common type of headlamp, this shape is provided by providing the headlamp bulb with its own shield which prevents an appropriate part of the light emanating from the filament from reaching the reflector. The bulb may also be provided with another shield (commonly called the "uplight" shield) which is disposed in front of the bulb envelope or filament and which prevents light from the filament from passing directly out of the headlamp without reflection off the reflector. The bulb filament is disposed a short distance in front of the focus of the reflector which is paraboloidal. The beam pattern produced by such an arrangement has a top edge cut-off formed by a horizontal section, a 15° upwardly sloping section, and an arcuate concave section disposed between the horizontal and upwardly sloping sections (see FIG. 2). This shape in itself is not capable of satisfying the Regulations and so a glass diffusion cover closing the open front of the reflector is provided with prisms thereon which modify the light beam pattern by shifting the images so that the arcuate concave section is filled in to produce the required inclined beam pattern (FIG. 1).

Figure 3:
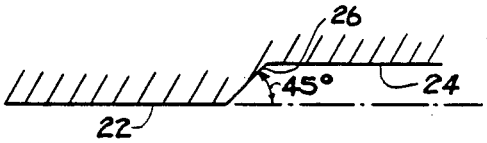

The second type of beam pattern permitted by the E C E Regulations is the so-called Z-beam pattern in which upper and lower horizontal sections are separated by a short intermediate section inclined at about 45° to the horizontal (See FIG. 3). It has been proposed, for example in GB No. 1347357 to perform this type of beam by providing suitably shaped and positioned prismatic zones in the glass diffusion cover. However, to produce the required effect necessitates very accurate moulding of the prismatic zones and this is not possible in glass. Also, problems arise where the glass diffusion cover is required by the motor vehicle manufacturer to be inclined with respect to the optical axes of the reflector.

Further, problems arise with obtaining an acceptable beam pattern in rectangular headlamps having a high aspect ratio, i.e. headlamps having a substantially rectangular front opening whose width is substantially greater than its height (e.g. of the order of 250% to 350% greater), since the light collection area of the reflector is necessarily relatively low. Also, the upper planar portion of the reflector body in a high aspect ratio headlamp is disposed quite close to the bulb in use and so can lead to overheating problems which can affect the surface finish of the reflective regions of the reflector body and reduce the effective life of the headlamp.

An object of one aspect of the present invention is to obviate or mitigate the above disadvantages.

According to said one aspect of the present invention, there is provided a headlamp having a dished reflector provided with a front opening and a light source displaced below the horizontal median line of the headlamp, and a light source shield arrangement providing a horizontal cut-off on both sides of the light source, said reflector having a pair of lateral curved reflective portions with coincident foci, wherein the lateral curved reflective portions have their optical axes mutually inclined, preferably both horizontally and vertically, by such an extent that the beam pattern projected by the headlamp from the light source filament has, at 25 meters from the headlamp, (1) a lower beam portion having a horizontal upper cut-off, (2) an intermediate beam portion which has an upwardly inclined cut-off extending from one side of the upper cut-off of the lower beam portion, and (3) an upper beam portion having a horizontal upper cut-off extending from the inclined cut off on the opposite side thereof to the lower beam portion, the lower beam portion being provided by one of the curved reflective portions and the intermediate and upper beam portions being provided by the other of the curved reflective portions.

In a preferred embodiment, the pair of lateral curved reflective portions are separated by an upper curved reflective portion having a shorter focal length than the lateral curved reflective portions but having its focus coincident with the foci of latter.

Whilst each of the curved reflective portions may lie on a surface defined by rotation of a non-circular conic section about its axis, e.g. a paraboloid, it may lie any other curved surface having a focus, for example a surface defined by rotation of an ellipse about a line which (a) is inclined at a small angle of, for example, 1 to 2 degrees with respect to the major axis of the ellipse and (b) intersects the major axis at the inner focal point of the ellipse.

The upwardly inclined cut-off will usually be of concave form.

In a preferred embodiment, said one of the lateral curved reflective portions is disposed so as to have its optical axis aligned with that of the upper reflective portion, and said other of the lateral curved reflective portions has its optical axis inclined relative thereto both in the horizontal plane and upwardly.

It will be appreciated from the above, (1) that a high aspect ratio headlamp can be provided where the risk of overheating is less than if the light source were mounted at the centre of the headlamp, as is usual and (2) that the beam pattern is very close to the desired Z-beam pattern so that only very simple lensing, if any, need be provided on a glass cover for the headlamp.

The present invention is applicable to the headlamps where the light source is the filament of a bulb removably mounted in a rear opening of the reflector and where the shield arrangement is provided on the bulb itself or is separately provided and fitted in the reflector. The present invention is also applicable to so-called "sealed beam" headlamps where the light source is a filament mounted in sealed fashion within the headlamp.

The invention is applicable to reflectors having a generally rectangular front opening. Prior art reflectors of this type have upper and lower edges of the opening defined by upper and lower planar portions which take no part in reflection of the beam. In the present invention, such reflector may have no lower planar portion or may have one at some distance below the horizontal plane in which the coincident foci lie such lower planar portion; being spaced from such plane by a vertical continuation of the reflector shape at the horizontal centre line thereof. Such part would normally be hidden from view by panelling at the front of the vehicle below the headlamp recess. The vertical height of the lamp aperture would then be governed only by the distance between the light source and the upper planar portion. This height would typically be about 60 mm as opposed to a minimum height of about 100 mm required by the current prior art headlamps.

The concept of inclining the optical axes of two laterally disposed portions of the reflector relative to one another is also applicable to passing beam headlamps having a reflector with a circular front opening.

In another aspect of the present invention, this concept of inclining the optical axes is applicable to headlamps of the type where the reflective surface extends for a distance below the light source and a light source shield is used which provides a horizontal cut-off on one side of the light source and a downwardly inclined cut-off on the other side of the light source; in this case, however, the lateral reflective portions have their optical axes mutually inclined both in the horizontal and vertical directions so as shift the inclined cut-off portion towards the horizontal cut-off portion so as to approximate to the first-mentioned beam pattern permitted by the E C E Regulations (FIG. 1).

Figure 2:
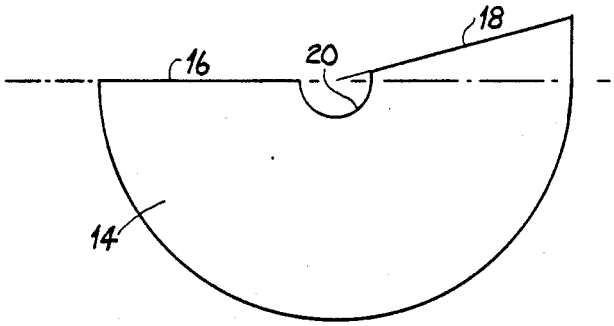
Figure 4:
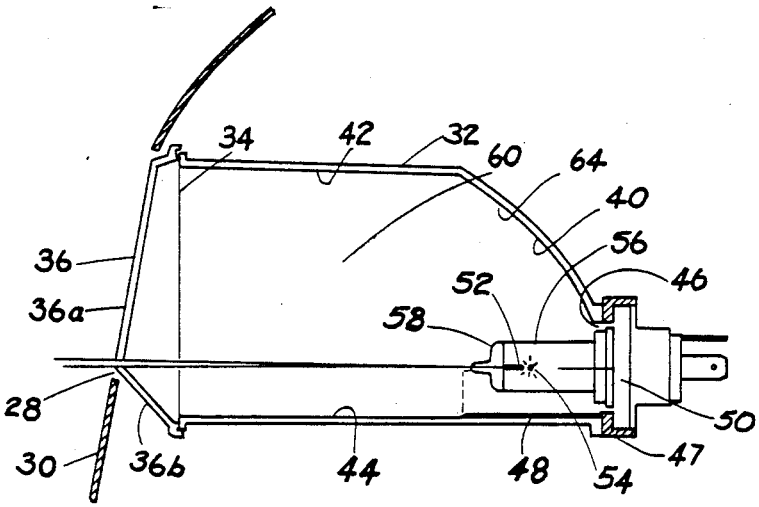
Figure 5:
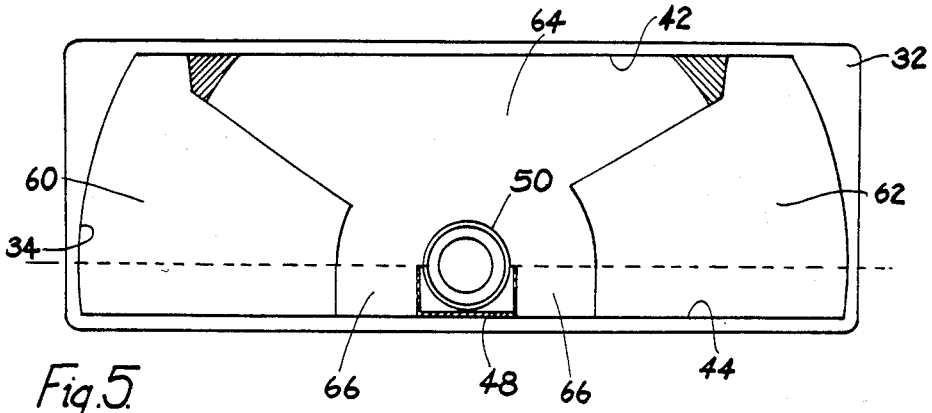
Figure 7:
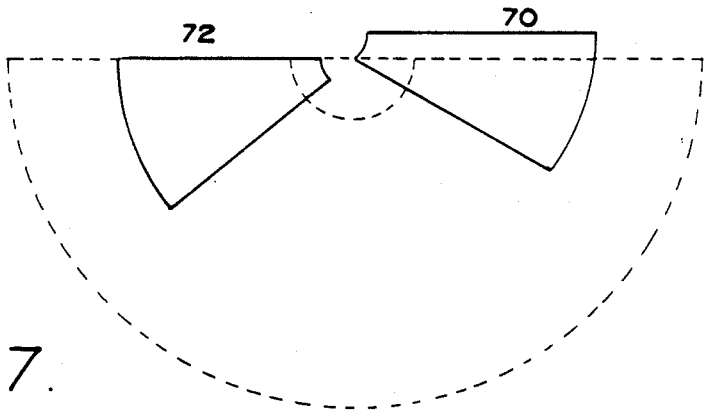
Figure 8:
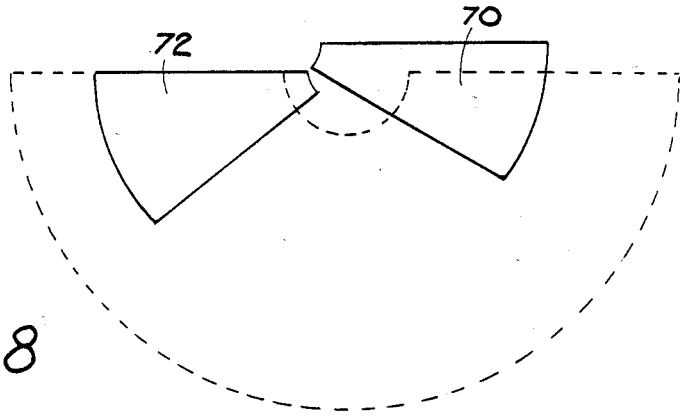
Figure 9:
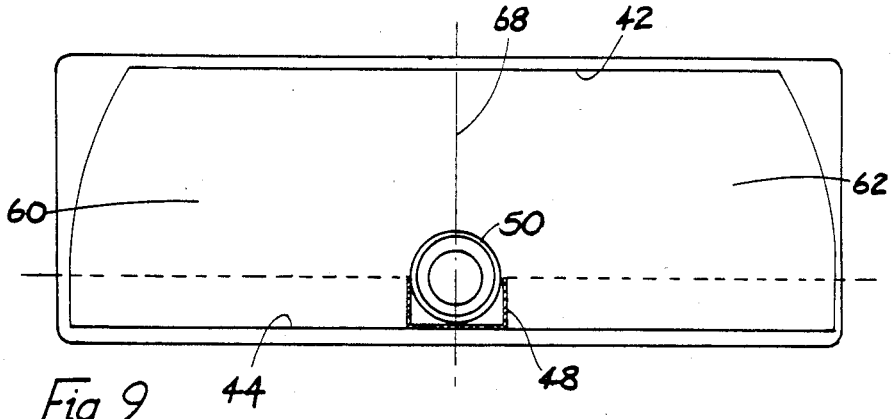
Figure 10:
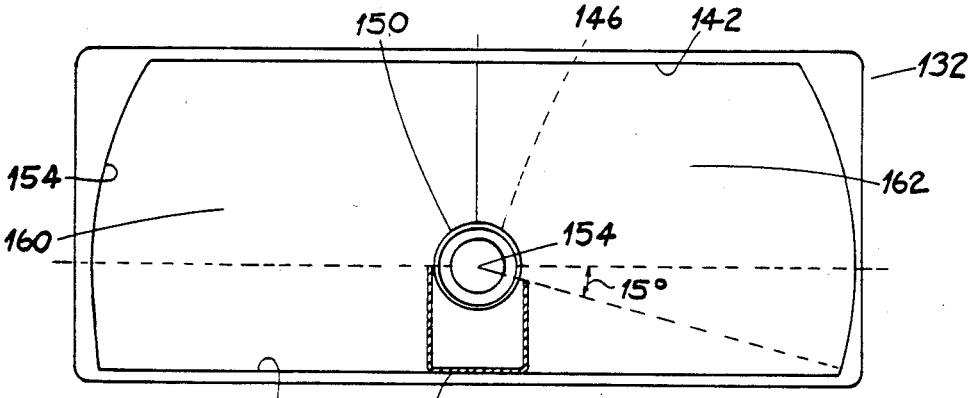
Figure 11:
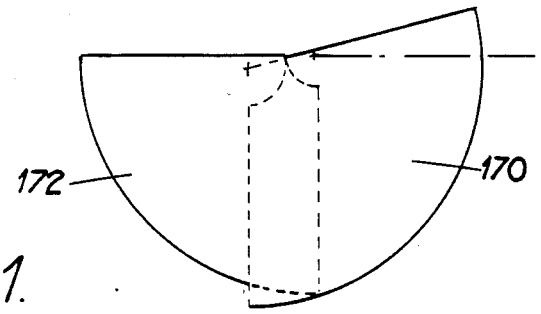
Figure 12:
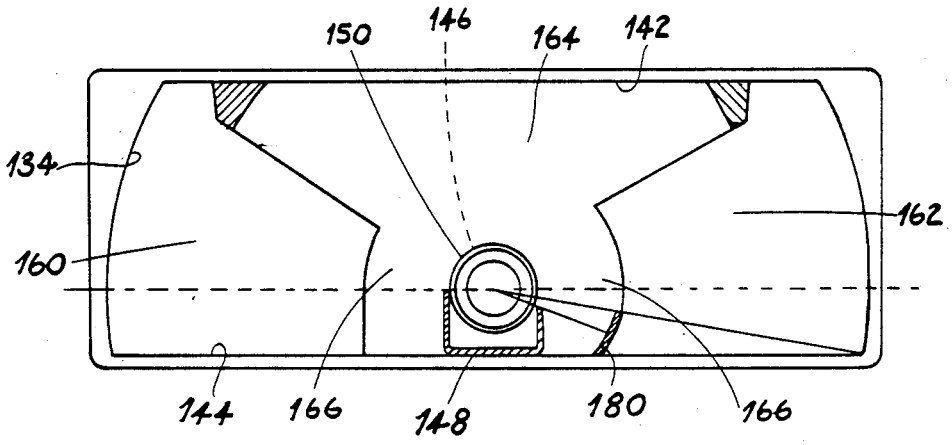

Embodiments of the present invention will now be described, by way of example, with reference to the accompanying drawings, in which:

FIG. 1 is a schematic illustration of the most popular form of sharp cut-off to the top of a beam projected by a headlamp, as required by E C E Regulations, FIG. 2 is a schematic illustration showing the basic beam pattern, i.e. the beam pattern without the interposition of a glass diffusion cover, produced by a conventional reflector fitted with a bulb having a conventional shielding arrangement, FIG. 3 is a schematic illustration of the sharp cut-off to the top of a beam pattern (a so-called Z-beam pattern) as also permitted by E C E Regulations, FIG. 4 is an axial section through one example of vehicle headlamp according to the present invention, FIG. 5 is a front view of the headlamp of FIG. 4, FIGS. 6 to 8 are schematic illustrations showing how the reflector in the headlamp of FIGS. 4 and 5 shifts the filament images to produce a beam pattern which has an upper cut-off approximating to the cut-off required by the so-called Z-beam illustrated in FIG. 3, FIG. 9 is a front view of an alternative form of road vehicle headlamp according to the present invention, FIG. 10 is a third embodiment of road vehicle headlamp according to the present invention, FIG. 11 is a schematic illustration of the manner in which portions of the beam pattern projected by the headlamp of FIG. 10 are moved relative to one another in order to produce an upper cut-off which very closely resembles that of FIG. 1, as required by E C E Regulations, and FIG. 12 is a front view of a fourth embodiment of a vehicle headlamp which is also intended to produce a beam pattern of the type illustrated in FIG. 11.

Referring now to FIG. 1 of the drawings, the cut-off to the top of the beam is defined by a horizontal section 10 and a 15° slope section 12 extending upwardly from one end of the former section. The cut-off to the top of the beam illustrated in FIG. 1 is in respect of headlamps fitted to motor vehicles intended to be driven on the right hand side of the road so that the horizontal cut-off section 10 prevents the beam from dazzling drivers of vehicles in the opposite direction, whilst the slope section 12 of the cut-off permits further illumination of the nearside curb. Of course, in countries where vehicles are driven on the left hand side of the road, the positions of the sections 10 and 12 will be reversed.

Referring to FIG. 2 the beam pattern 14 illustrated therein has a horizontal section 16, a 15° upwardly sloping section 18, and a concave arcuate section 20 separating the sections 16 and 18. This beam pattern 14 corresponds to the basic beam pattern projected by a conventional paraboloidal reflector fitted with a bulb and a conventional bulb shield arrangemnt. By the expression "basic beam pattern" is meant the beam pattern produced by images of the shielded bulb filament by reflection off the paraboloidal reflector without any interposed glass diffusion cover. The conventional paraboloidal reflector is normally provided with a conventional glass diffusion cover which contains prismatic zones. These prismatic zones serve to modify the basic beam pattern 14 so as to spread it horizontally and so as to fill in the concave arcuate section 20 in order to produce the type of cut-off illustrated in FIG. 1.

In FIG. 3, there is illustrated the type of cut-off required to produce the so-called Z-beam pattern. This cut-off comprises a lower horizontal section 22, an upper horizontal section 24, and a short intermediate section 26 inclined at about 45° to the horizontal. The upper cut-off illustrated in FIG. 3 is, like that of FIG. 1, intended to be produced by a headlamp for use on vehicles driven on the right hand side of the road. As will be appreciated from a comparison of FIGS. 1 and 3, the Z-beam pattern of FIG. 3 will give a rather better illumination of the road in front of the driver than that of FIG. 1. However, the Z-beam pattern is very critical in that slight inaccuracies in the distribution thereof can result in dazzle to drivers of oncoming vehicles.

Referring now to FIG. 4, the vehicle headlamp illustrated therein is a high aspect ratio rectangular headlamp which is fitted, in use, in a high aspect ratio aperture 28 provided in panelling 30 at the front of the motor vehicle. The lamp illustrated in FIG. 4 comprises a moulded resin body 32 having a substantially rectangular, high aspect ratio front opening 34 closed by a glass diffusion cover 36. In this embodiment the glass diffusion cover 36 has an upper portion **36*a* inclined at an angle of 10° to the vertical and a lower portion 36*b* extending rearwardly from the lower edge of the portion 36*a* at an angle of 45° to the horizontal. However, it is to be appreciated that the inclination of the upper portion 36*a* could be up to 45° to the horizontal, whilst that of the lower portion 36*b* will be set having regard to the design of the vehicle in the region of the lamp and the need to achieve a mouldable cover 36. The upper portion 36*a* occupies the whole of the aperture 28 whilst the lower portion 36*b* is hidden from view behind the panelling 30. The body 32 has a surface 40 which is provided with a metallised film e.g., a vacuum deposited aluminium film, serving to render it reflective. The body 32 is formed with upper and lower planar portions 42 and 44 respectively which are not intended to serve as reflective surfaces. The rear of the body 32 is formed with an opening 46 adjacent the lower planar portion 44. A diecast bulb holder 47 is secured to the body 32** around the opening 46. The bulb holder 47 is integrally diecast with a filament shield 48 which extends into the body 32 and rests against the lower planar portion 44 and which, in addition to its function as a filament shield, also serves as a heat shield to prevent thermal damage to the lower planar portion 44. Disposed within the bulb holder 46 is a bulb 50 having a filament 52 disposed at the focus 54 of the optical system to be described hereinafter provided by the reflective surface 40. The bulb 50 has a glass envelope 56 on the end of which is provided, in a conventional manner, a black coating defining an uplight shield 58 which prevents light rays from the filament 52 passing directly through the diffusion cover 36. The filament shield 48, as can be seen from FIG. 5, is of square U-section with the arms of the U terminating at the level of the filament 52.

The reflective surface 40 is constituted by a pair of lateral curved reflective portions 60 and 62, each of which lies on a respective surface defined by rotation of an ellipse about a line which (a) is inclined at an angle of 1.5 degrees, in this embodiment, with respect to the major axis of the ellipse and (b) intersects the major axis at the inner focal point of the ellibodiment, with respect to the major axis of the ellipse and (b) intersects the major axis at the inner focal point of the ellipse. Such shape has an inner focal point and an outer focus in the form of an annulus. The lateral curved reflective portions 60 and 62 are mutually inclined but nevertheless have the same focal length and have their inner foci coincident at 54. This shape approximates to a paraboloid but has a more advantageous image distribution. The lateral reflective portions 60 and 62 are separated by an upper reflective portion 64 which, in this embodiment, also lies on a similarly curved surface which is focussed at 54 and which is aligned with portion 60 . However, the curved surfaces associated with the lateral reflective portions 60 and 62 have a longer focal length than that associated with the upper reflective portion 64. Instead of lying on a single curved surface, the reflective portion 64 may be divided vertically into two parts which are mutually inclined in a like manner to the portions 60 and 62. The reflective portion 64 has in this embodiment extensions 66 disposed on opposite sides of the rear opening 46, the extensions 66 lying on the same surface as that of the reflective portion 64. Thus, the upper reflective portion 64, when taken together with its extension 66 extends for the complete height of the reflector body 32 but not for the complete width thereof. Also, the upper reflective portion 64 extends from the rear opening 46 only as far as the upper planar portion 42. In contrast, the lateral reflective portions 60 and 62 extend to the front opening 34 of the body 32 but, because of the existence of the extensions 66 do not extend rearwardly to the rear opening 46. The upper reflective portion 64 is shaped so that the outer regions of the reflective portions 60 and 62 extend over the full height of the body 32.

Figure 6:
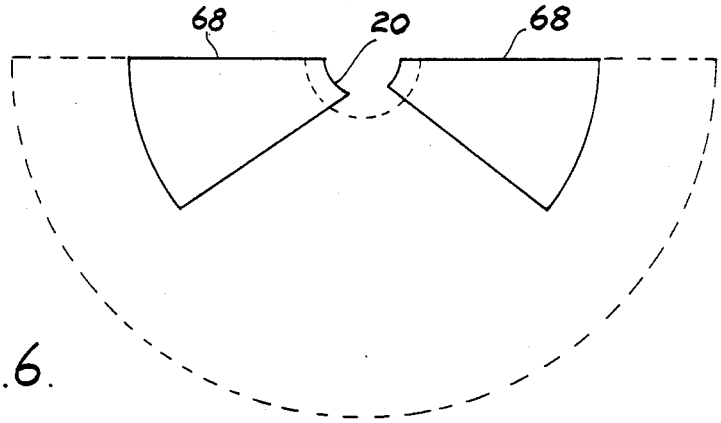

Referring now to FIGS. 6 to 8, the basic beam pattern projected by the above described headlamp corresponds closely to the pattern illustrated in full line in FIG. 8. However, first reference is drawn to FIG. 6 which shows the type of basic beam pattern which would be produced by the headlamp of FIGS. 4 and 5 if the lateral reflective portions 60 and 62 lay on the same curved surface. The effect of the arms of the bulb shield 48 is to produce an upper cut-off having a pair of horizontal sections 68 separated by the usual arcuate concave section 20 which, is semi-circular. In FIG. 6, the full lines show the contribution which would be provided by the lateral reflective portions 60 and 62 to the beam pattern whilst that provided by the reflective portion 64 is shown in dotted line. The same applies to FIGS. 7 and 8. Referring now to FIG. 7, this drawing illustrates the effect produced by arranging the curved surface on which the lateral reflective portion 62 lies so that it is upwardly inclined at an angle of 0.25° to the horizontal, whilst maintaining its focus at 54. Under such circumstances, the lateral reflective portion 62 produces region 70 of the basic beam pattern illustrated in FIG. 7.

In order to produce the basic beam pattern illustrated in FIG. 8, the optical axis of the surface on which the lateral reflective portion 60 lies is horizontally inclined relative to the longitudinal axis of the body 32 whilst maintaining its focus at 54. The angle of inclination, in this embodiment, is 0.75°. This inclination results in region 72 being shifted from the position illustrated in FIG. 7 to the position illustrated in FIG. 8. It will be seen that the contribution provided by reflective portion 64 has also been shifted (dotted line).

In an alternative embodiment, instead of horizontally shifting region 72, a similar effect to blend the image regions 72 and 70 could be achieved using non-critical, horizontal spreading lensing on the diffusion cover.

In the above description relative to FIGS. 6 to 8, it is to be appreciated that the beam patterns are diagrammatically illustrated therein and correspond to their shape at a location 25 meters in front of the vehicle headlamp since it is at this 25 meter location that the beam must satisfy certain photometric requirements laid down under the E C E Regulations for homologation purposes.

It will be seen that the basic beam pattern of FIG. 8 produces an upper cut-off which is very close to that required for a Z-beam cut-off (see FIG. 3). Accordingly, any prismatic zones provided on the upper portion 36*a* of the diffusion cover 36 can be made extremely simple and will be provided merely to produce a horizontal spread of light below the critical cut-off region. In the above embodiment, the upper reflective portion 64 and associated extensions 66 produce an overall diffuse zone of illumination as indicated by the dotted line in FIG. 8. The lateral reflective portions 60 and 62 mainly serve to provide high intensity, small filament images at the critical parts of the upper cut-off adjacent to the upwardly inclined intermediate section thereof.

Referring now to FIG. 9, the embodiment illustrated therein is similar to that of FIGS. 4 and 5 except that it is a simplified version with the upper reflective portion 64 and extension 66 thereof omitted so that the lateral reflective portions 60 and 62 occupy the whole of the area of the reflective surface 40 and are split by a vertical line 68 passing through the bulb axis. The lateral reflective portions 60 and 62 of the headlamp of FIG. 9 are mutually inclined in the manner described hereinabove with reference to FIGS. 4 and 5 to produce a basic beam pattern of the type illustrated in full line in FIG. 8.

Referring now to FIG. 10, the embodiment illustrated therein is similar to that of FIG. 9 except that curved reflective portions 160 and 162, corresponding to curved reflective portions 60 and 62, are not mutually inclined in quite the same manner as that described above. In this headlamp, the object is to produce a basic beam pattern of the type illustrated in full line in FIG.

11, i.e. to produce a basic beam pattern having an upper cut-off corresponding closely to that described above with reference to FIG. 1. In this embodiment, bulb 150 and bulb shield 148 is arranged in a similar manner to above described bulb 50 and bulb shield 48 except that the right hand arm of the U-shaped shield 148 does not extend upwardly as far as the left hand side thereof. This exposes a 15° segment of the lateral reflective surface 162 below a horizontal plane passing through focus 154 of bulb 150. The left hand arm of the bulb shield 148 terminates at the level of the focus 154. Such an arrangement of bulb shield 148 produces the required horizontal and 15° upwardly inclined sections of the upper cut-off to the basic beam pattern. In this embodiment, the lateral reflective portion 160 lies on a curved surface whose axis is inclined at an angle $\frac{1}{3}$° horizontally relative to the longitudinal axis of body 132. The lateral reflective portion 162 lies on a curved surface which is similarly inclined in a horizontal direction but which is also inclined by $\frac{1}{3}$° below the horizontal so as to produce the required shape of the upper cut-off at 25 meters from the front of the headlamp.

Referring now to FIG. 12, the headlamp illustrated therein is similar to that of FIG. 10 in that it is intended to produce the type of basic beam pattern illustrated in FIG. 11. However, in this embodiment, the lateral reflective portions 160 and 162 are separated by an upper reflective portion 164 with extensions 166 which have the same form as that described above with reference to portions 64 and extensions 66. Like the embodiment of FIGS. 4 and 5, all of the reflective portions 160, 162 and 164 including the extensions 166 are focussed at the same point which lies just on the filament of the bulb 150.

The right hand arm of the bulb shield 148 provides a 15° cut-off in respect of light which is incident upon the right hand extension 166, as was the case in respect of reflective portion 162 in FIG. 10. However, in this embodiment, a further shield 180 is disposed outwardly of the right hand extension 166 and provides a $7\frac{1}{2}$° cut-off in respect of light which is incident upon the reflective surface 162. Such an arrangement is more compact vertically than that of FIG. 10 i.e. it enables a higher aspect ratio.

In the above described embodiments, the axis of the filament of the bulb 50 or 150 coincides with the longitudinal axis of the body 32 and is horizontally disposed. Further, in the embodiments of FIGS. 4 and 5 and FIG. 12, the longitudinal axis of the bulb filament is aligned with the optical axis of the respective reflective portion 64 or 164.

In all of the above described embodiments, the bulb 50 or 150 and consequently the heat producing filament thereof is disposed below the horizontal median plane of the reflector and adjacent the lower planar surface 44 or 144 but is shielded therefrom by the diecast bulb shield 48, 148. The bulb filament is disposed sufficiently far below upper planar portion 42 or 142 for there to be no risk of heat damage thereto.

In the embodiment of FIGS. 4 and 5, the dimensions etc. of the reflector body 32 are typically as follows:

Overall height = 72 mm (between upper and lower planar portions 42 and 44)

Width = 250 mm

Depth = 135 mm

Focal length of lateral reflective portions 60, 62 = 35 mm

Focal length of reflective portion 64 = 20 mm

Visible height of opening 34 and vertical distance of filament 52 below upper planar portion 42 = 60 mm The embodiments of headlamp described above are all motor vehicle headlamps which are intended to produce only a passing beam pattern as will be appreciated from the fact that they all produce an upper cut-off to the beam pattern. However, the present invention is applicable to a combined passing and driving beam headlamp, in which case a second filament (which is used under driving beam conditions) is provided behind the passing beam filament.

The present invention is applicable not only to headlamps of the type having a rear aperture in which a bulb is mounted, but also to so-called sealed beam headlamps where no rear aperture is provided and a light source such as an electric filament is mounted at the required location within a permanently sealed reflector.

In the above described embodiments, each pair of lateral reflective portions 60 and 62, and 160 and 162, respectively, have the same focal length and are of the same length (i.e. the front opening to the rear aperture dimension in the case of a reflector fitted with a bulb). However, it is within the scope of the present invention for the lengths and/or the focal lengths of the lateral reflective portions to be different. For example, in a headlamp in which the diffusion cover is inclined widthwise of the headlamp relative to a plane perpendicular to the main axis of the headlamp, one of the lateral reflective portions may be longer and have a shorter focal length than the other lateral reflective portion.

I claim:

1. A headlamp having a dished reflector provided with a front opening and a light source disposed below the horizontal median line of the headlamp, and a light source shield arrangement providing a horizontal cut-off on both sides of the light source, said reflector having a pair of lateral curved reflective portions with coincident foci, wherein said lateral curved reflective portions have their optical axes mutually inclined both horizontally and vertically by such an extent that the beam pattern projected by the reflector from the shielded light source has, at 25 meters from the headlamp, (1) a lower beam portion having a horizontal upper cut-off, (2) an intermediate beam portion which has an upwardly inclined cut-off extending from one side of the upper cut-off of the lower beam portion, and (3) an upper beam portion having a horizontal upper cut-off extending from the inclined cut off on the opposite side thereof to the lower beam portion, said lower beam portion being provided by one of the curved reflective portions and the intermediate and upper beam portions being provided by the other of said curved reflective portions.

2. A headlamp as claimed in claim 1, wherein said pair of lateral curved reflective portions are separated by an upper curved reflective portion having a shorter focal length than said lateral curved reflective portions and having its focus coincident with the foci of latter.

3. A headlamp as claimed in claim 2, wherein said one of said lateral curved reflective portions is disposed so as to have its optical axis aligned with that of the upper reflective portion, and said other of the lateral curved reflective portions has its optical axis inclined relative thereto both in the horizontal plane and upwardly.

4. A headlamp as claimed in claim 2 or 3 wherein the upper curved reflective portion is provided with extensions disposed on opposite sides of said rear opening, said extensions lying on the same surface as that of the upper curved reflective portion.

5. A headlamp as claimed in claim 2, wherein said upper curved reflective portion is divided vertically into two parts which are mutually inclined in a like manner to the lateral curved reflective portions.

6. A headlamp having a dished reflector provided with a front opening and with a light source disposed below the horizontal median line of the headlamp, and a filament shield arrangement providing a horizontal cut off on one side of the light source and a downwardly inclined cut-off on the other side of the light source, said reflector having a pair of lateral curved reflective portions with coincident foci, wherein the lateral curved reflective portions have their optical axes mutually inclined both in the horizontal and vertical directions so that the beam pattern projected by the reflector from the shielded light source has, at 25 meters from the headlamp, a horizontal cut-off portion from one end of which extends an upwardly inclined cut-off portion.

7. A headlamp as claimed in claim 6, wherein the lateral curved reflective portions are separated by an upper curved reflective portion having a shorter focal length than the lateral curved reflective portions but having a focus coincident with the foci of the latter.

8. A headlamp as claimed in claim 7, wherein the shield arrangement includes a shield defining said horizontal cut-off and a downwardly inclined cut-off for light incident upon a downward extension of the upper curved reflective portion, and a further shield defining a further downwardly inclined cut-off of smaller inclination than the first mentioned downwardly inclined cut off, said further shield being disposed outwardly of said downward extension so as to provide a cut-off in respect of light incident upon one of said lateral curved reflective portions.

9. A headlamp comprising a dished reflector provided with a front opening (34) and a light source (52), and a light source shield arrangement (48) providing a horizontal cut-off on both sides of the light source (52), said reflector having a pair of lateral curved reflective portions (60 and 62) with coincident foci, wherein the lateral curved reflective portions (60 and 62) have their optical axes mutually inclined both horizontally and vertically by such an extent that the beam pattern projected by the reflector from the shielded light source has, at 25 meters from the headlamp, (1) a lower beam portion (72) having a horizontal upper cut-off and (2) an upper beam portion having a horizontal upper cut-off the lower beam portion (72) being provided by one (60) of the curved reflective portions (60) and the upper beam portion (70) being provided by the other (62) of the curved reflective portions, characterized in that the light source (52) is disposed below the horizontal median line of the headlamp, in that the lateral curved reflective portions (60 and 62) also have their optical axes mutually inclined horizontally, in that the extent of the mutual horizontal and vertical inclination of the lateral curved reflective portions is such that the beam pattern projected by the reflector from the shielded light source has, at 25 meters from the headlamp, an intermediate beam portion which is disposed between the upper and lower beam portions and which has a cut-off extending from one side of the upper cut-off of the lower beam portion to an adjacent side of the upper beam portion, and in that the intermediate beam portion is provided by said other (62) of the curved reflective portions.

* * * * *

UNITED STATES PATENT AND TRADEMARK OFFICE

CERTIFICATE OF CORRECTION

PATENT NO. : 4,575,787

DATED : March 11, 1986

INVENTOR(S) : David A. Brit

It is certified that error appears in the above-identified patent and that said Letters Patent is hereby corrected as shown below:

In Column 5, lines 23-25, Cancel "ellibodiment, with respect to the major axis of the ellipse and (b) intersects the major axis at the inner focal point of the"

Signed and Sealed this

*Seventeenth* Day of *June 1986*

[SEAL]

*Attest:*

DONALD J. QUIGG

*Attesting Officer*

*Commissioner of Patents and Trademarks*